US007987540B2

(12) United States Patent
Schroeder et al.

(10) Patent No.: US 7,987,540 B2
(45) Date of Patent: Aug. 2, 2011

(54) LAUNDRY MACHINE SYSTEM FOR ENHANCED PROCESS AUTOMATION AND CONTROL

(75) Inventors: Paul D. Schroeder, Ripon, WI (US); Gary L. Ziesemer, Green Lake, WI (US); Jason J. Mader, Ripon, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 839 days.

(21) Appl. No.: 11/937,252

(22) Filed: Nov. 8, 2007

(65) Prior Publication Data

US 2009/0120136 A1 May 14, 2009

(51) Int. Cl.
*D06F 33/02* (2006.01)

(52) U.S. Cl. ..... 8/158; 340/5.51

(58) Field of Classification Search ..... 340/5.1, 340/5.2, 5.51; 8/158, 159
See application file for complete search history.

(56) References Cited

U.S. PATENT DOCUMENTS

2002/0065770 A1* 5/2002 Ebata ..... 705/39
2003/0210126 A1 11/2003 Kanazawa

FOREIGN PATENT DOCUMENTS

CH 695401 A5 4/2006
EP 0978773 A1 2/2000
EP 1030235 A2 8/2000
KR 20060020529 A 3/2006

OTHER PUBLICATIONS

Electronic translation of EP 0978773 A1, date not applicable.*

* cited by examiner

*Primary Examiner* — Joseph L Perrin
(74) *Attorney, Agent, or Firm* — Leydig, Voit & Mayer, Ltd.

(57) ABSTRACT

A control system for a laundry machine provides a system for engaging a laundry machine in a drop-off mode, allowing an operator to use the machine as necessary to process customer garments without being required to activate the machine via a payment interface. In an embodiment of the invention, the system provides a lock-out function for allowing a machine to be reserved for a specific user holding a predetermined password or code. In a further embodiment of the invention, the laundry machine is configured with a low power and/or shut down facility, whereby the power consumption of the machine may be greatly reduce during idle periods.

15 Claims, 6 Drawing Sheets

LAUNDRY MACHINE SYSTEM FOR ENHANCED PROCESS AUTOMATION AND CONTROL

FIELD OF THE INVENTION

The invention generally relates to laundry machines, and more particularly to a control system for a laundry machine for improving the efficient utilization of the machine.

BACKGROUND OF THE INVENTION

Many commercial laundry machines are designed to allow users, e.g., members of the public, to activate the machines and use them for washing garments. Typically users will pay for the service provided by the machine via the insertion of coins, cash, cards, etc. However, it is often desirable for a machine to be available on a more limited basis, i.e., for use by a facility operator without paying, or for use by members of the public on a reservation basis. However, present systems for allowing these types of actions are not satisfactory, requiring excess operator involvement or oversight. In addition, such machines may be very expensive to operate with respect to their use of electrical energy, however, it is difficult to manage the power consumption of such machines, especially when the machines are not in active use.

SUMMARY OF THE INVENTION

In view of the foregoing, it is an object of the invention to provide a system and method for engaging a laundry machine, e.g., a washer, dryer, tumbler, etc., in a drop-off mode, allowing an operator to use the machine as necessary to process customer garments without being required to activate the machine via a payment interface.

To that end, it is a related object to provide a control system for a washer with a lock-out function for allowing a machine to be reserved for a specific user holding a predetermined password or code.

It is a further related object of the invention to provide a laundry machine with a low power and/or shut down facility, whereby the power consumption of the machine may be greatly reduced during idle periods.

These objects and other related objects are achieved in various embodiments of the present invention. The features and advantages of the invention can be understood from the description of embodiments of the invention set forth below with reference to the drawings, in which:

DETAILED DESCRIPTION OF THE INVENTION

Figure 1:
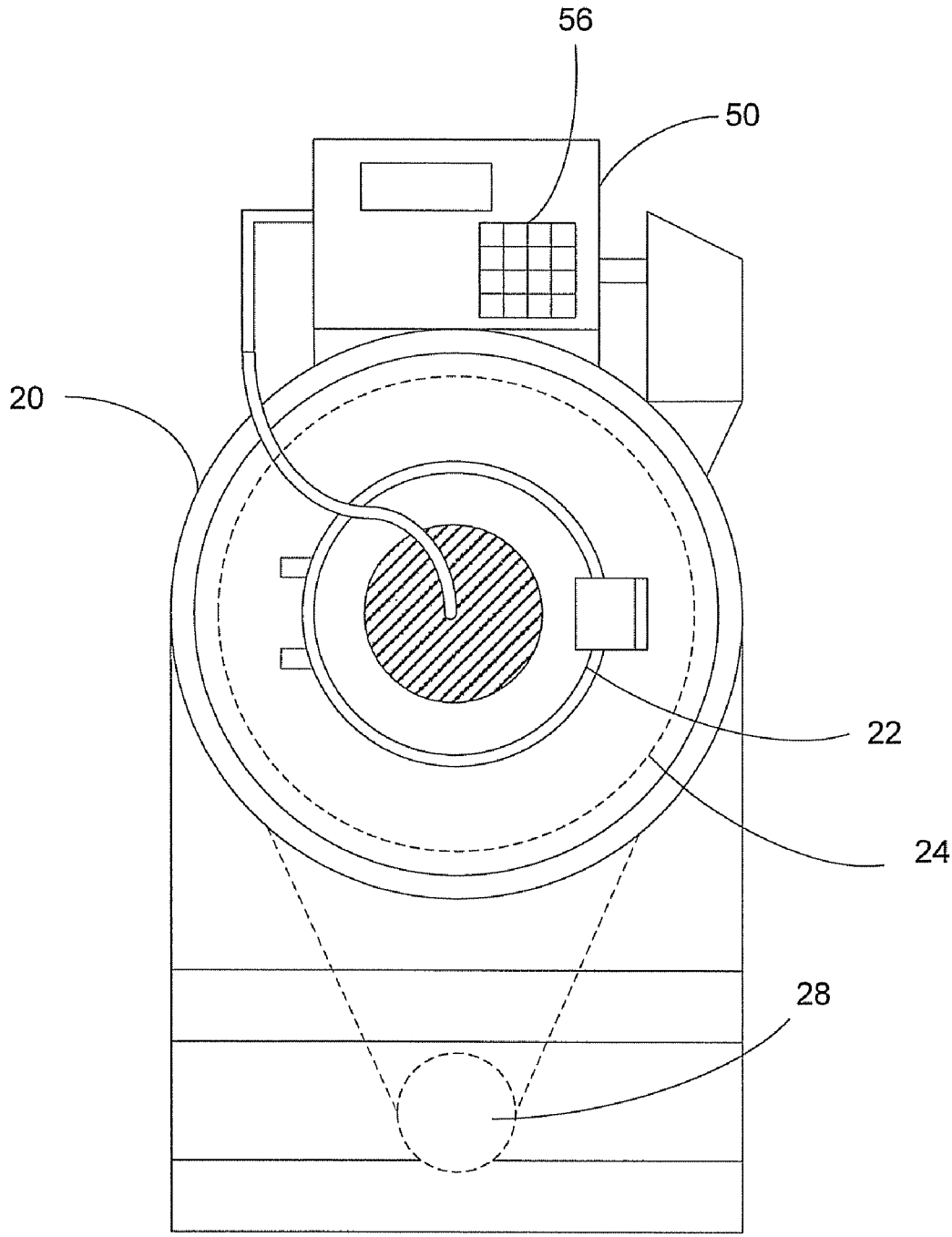
FIG. 1 is a partially schematic front view of a washer/extractor-type laundry machine with a wash drum therein that rotates about a generally horizontal axis.

FIG. 1 shows a laundry machine 20 that incorporates an embodiment of the control system for controlling the operation of the machine 20 in accordance with described embodiments of the invention. In the embodiment shown in FIG. 1, the laundry machine 20 is of the front-loading washer-extractor type, with a front door 22 that can be opened for loading clothing to be cleaned into the machine. The laundry machine has a wash drum 24 into which the clothing is loaded. The drum 24 is supported in the washer-extractor for rotation about a generally horizontal central axis. During the washing and rinsing phases of the cleaning operation, the drum 24 is partially filled with water (or other solvent used for cleaning) and is rotated at relatively low speeds to tumble the clothing to enhance the cleaning effects. After the washing and rinsing phases are completed, the drum 24 with the wet clothing therein is rotated at a relatively high angular velocity to remove (or "extract") residual water from the wet clothing by means of centrifugal force. To effectively extract water from the clothing, the rotational velocity of the drum 24 is often relatively high, generating centrifugal forces as great as 300 times the earth's gravitational field force.

Figure 2:
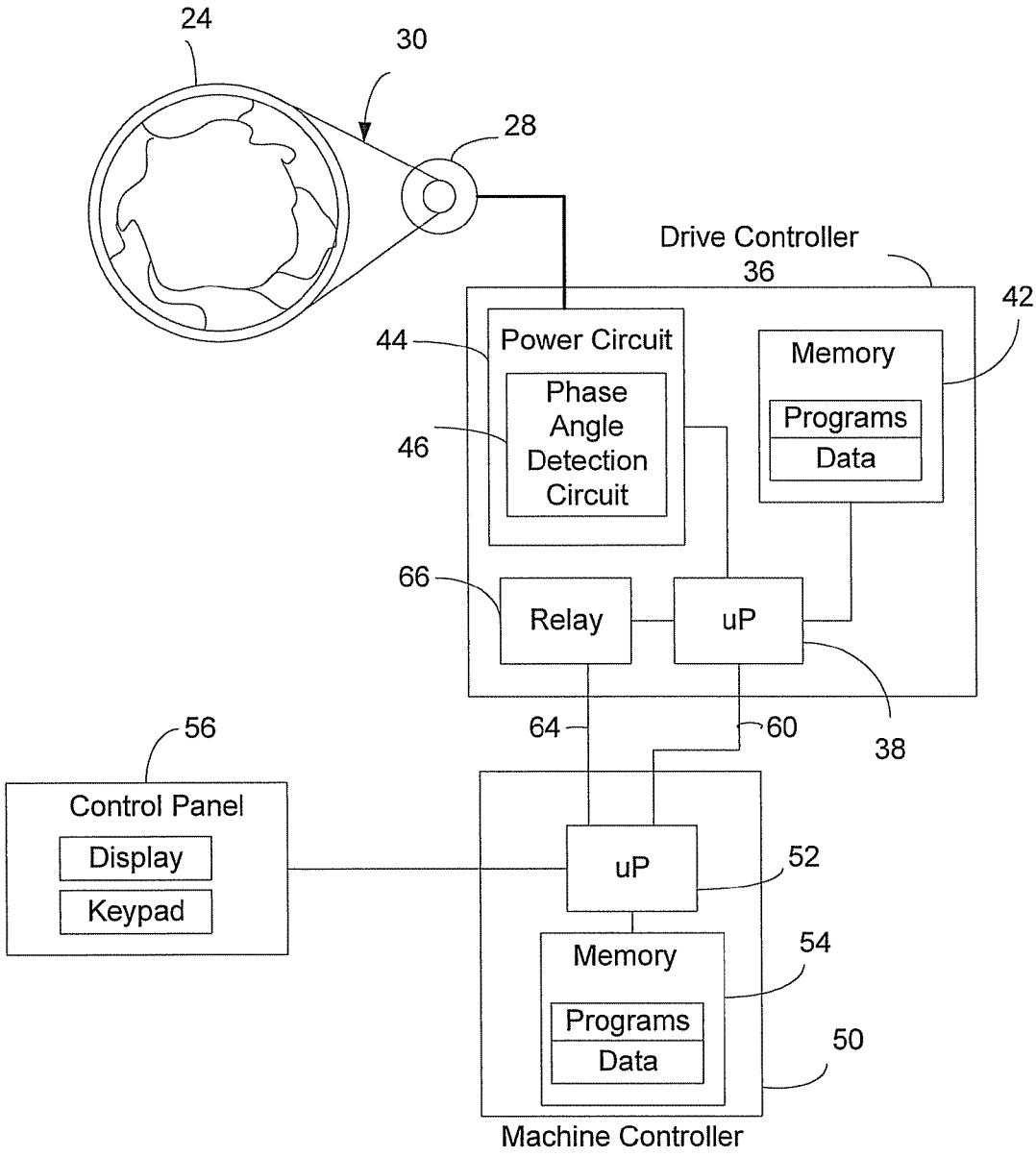
FIG. 2 is a schematic view showing the functional modules of the laundry machine.

As shown in FIG. 2, the drum 24 is driven by a motor 28, which is coupled to the drum 24 via suitable means such as belt/pulley arrangement 30 or gears. The motor 28 may be, for example, an AC motor that provides a torque sufficient for driving the drum 24 with wet clothing therein to desired rotational speeds. The motor 28 is powered by a drive controller 36, which provides the needed voltage and current for energizing the motor 28. In one embodiment, the drive controller 36 includes a microprocessor 38 that is suitably programmed for controlling the powering of the motor 28, and a non-volatile memory 42 for storing programs and control data for the microprocessor 38. The non-volatile memory 42 may be read-only, and the programs stored in such a non-volatile memory 42 are commonly referred to as "firmware." The drive controller 36 further includes a power circuit 44 that provides the current and voltage for the motor 28 under the control of the microprocessor 38. As described in greater detail below, the power circuit includes a detection circuit 46 for sensing a phase angle difference between the voltage and current applied to the motor 28.

To control its general operations, the laundry machine 20 includes a machine controller 50. The machine controller 50 sends control signals to various components of the laundry machine 20, including the drive controller 36, for carrying out a selected washing operation, which may include multiple washing, rinsing, and extraction phases. The machine controller 50 includes a control panel 56 that can be used by a user to enter operation instructions and parameters. The machine controller 50 includes a microprocessor 52 and a non-volatile memory 54 for storing program software and operation data. In a preferred embodiment, the memory 54 for storing the software programs for the microprocessor 38 is read-only.

To control the operations of the laundry machine 20 and to receive operational information, the machine controller 50 is interfaced with active components of the laundry machine 20 by means of appropriate communication and power connections. As shown in FIG. 2, the machine controller 50 is connected to drive controller 36 for the motor 28 driving the wash drum 24 by means a communication line 60, which may be used by the machine controller 50 to send control signals or instructions to the drive controller 36. The machine controller 50 is further connected to the drive controller 36 by a signal line 64 for receiving data from the drive controller 36. The signal line 64 connects the machine controller 50 to a signaling device in the drive controller 36 circuit. In one embodiment, the signaling device is a relay 66, which may be a mechanical relay or a transistor-based solid-state device. As described in greater detail below, the relay 66 is operated by the drive controller 36 to provide a digital signal that indicates the magnitude of a detected imbalance of the laundry load in the drum.

Figure 3:
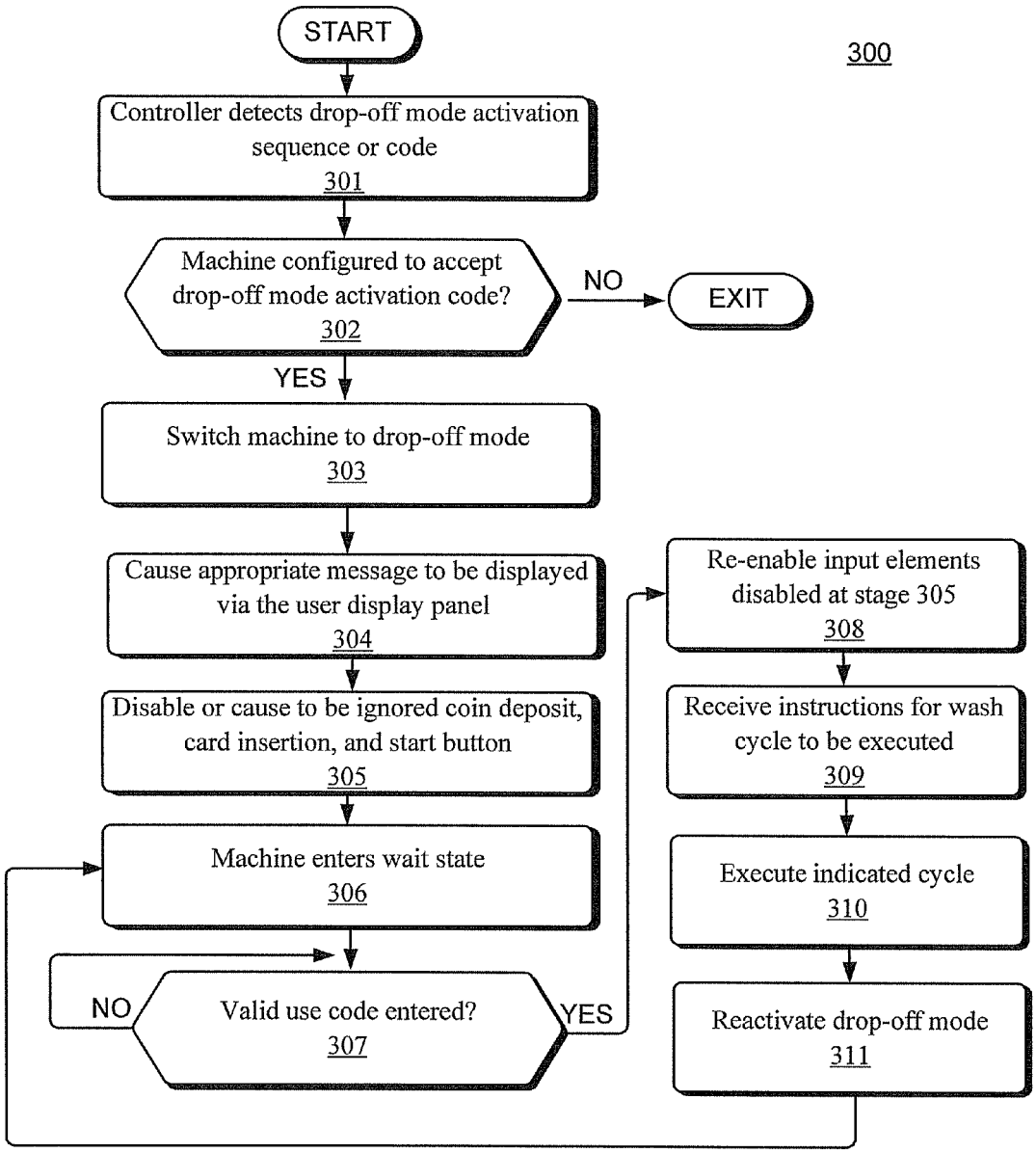
FIG. 3 is a flowchart showing a process of initiating and functioning within a drop-off mode according to an embodiment of the invention.

Turning now to FIG. 3, to initiate and function within a drop-off mode, the controller functions according to computer-executable instructions on a computer-readable medium, in conjunction with data and information stored on the same or different medium. The process stages of FIG. 3 illustrate the manner in which the aforementioned instructions are executed, although it will be appreciated that other instructions and sequences may be used without departing from the spirit of the invention.

For entering the drop-off mode, the controller 50 detects a drop-off mode activation sequence or code at stage 301. The activation code may be presented to the controller 50 via user-manipulation of the user interface 56 or may be sent to the controller 50 via a network or other communication link. For example, in a commercial laundry facility open to the public, an operator of the facility may desire to program machines from a central location, and may program one or more machines to enter the drop-off mode.

In accordance with a feature of the invention, once the drop-off activation code is received, the machine controller 50 determines at stage 302 whether the machine is configured to accept such a code. For example, a machine may be programmed via a configuration file or setting to enable or disable activation of the drop-off mode. If it is determined at stage 302 that the machine is not configured so as to enable activation of the drop-off code, then the process 300 exits after stage 302. Otherwise, the process moves forward to stage 303, wherein the machine switches to a drop-off mode. Pursuant to entering the drop-off mode, the controller causes an appropriate message to be displayed via the user display panel in stage 304. For example, the display may be changed to read "busy" or other appropriate message to alert potential users that the machine is not available for use at the moment.

In addition, at stage 305 the controller disables certain control inputs of the machine. For example, in an embodiment of the invention, the controller 50 may disable or cause to be ignored any coin deposit, card insertion, start button depression and/or other control inputs usable to use the machine in modes other than the drop-off mode. However, the keypad preferably remains enabled so that a user code may be entered as will be discussed below. In addition, the connection of the machine to the network or other communications link may be maintained such that instructions or user codes for the machine 20 may be provided from the central control location if needed.

In an embodiment of the invention, if the machine 20 is executing a wash cycle when the drop-off activation code is received, the machine 20 continues to the completion of the cycle. In a further embodiment of the invention, an override code may be provided via the user interface 56 or the network connection to halt the operation of the machine 20 mid-cycle after the drop-off activation code is received and cause the machine 20 to enter the drop-off mode immediately. The override code may be a sequence or combination of input button key strokes. For example, one possible key combination usable as an override code is the simultaneous depression of both the #5 and #6 keys. Other combinatorial and/or sequential codes may be used as desired.

At stage 306, the controller 50 causes the machine to enter a wait state. In the wait state, the machine 20 is not usable other than by entry of a user code. At stage 307, the controller 50 determines whether a valid user code has been entered. Typically, a user code may be entered by entering the digits of the code via the user interface keypad 56, followed by pushing a "start" button or similar button. If entry of a valid user code is not detected in stage 307, the process loops back through stage 307 until entry of a valid user code is detected. At this point, the process flows to stage 308. It will be appreciated that the wait state may be exited other than by entry of a separate and distinct valid user code if desired by the manufacturer or facility operator. For example, reentry of the drop-off mode activation sequence or code may be received to exit the drop-off mode.

At stage 308 of process 300, the controller 50 re-enables any input elements that were disabled at stage 305. For example, in an embodiment of the invention, the controller 50 re-enables the coin deposit, card insertion, start button and/or other control inputs usable to use the machine 20 in modes other than the drop-off mode. In an embodiment of the invention, although the coin deposit and/or card insertion devices may be enabled, the machine 20 is configured to operate free of charge once the valid user code is input to the machine.

At stage 309, the machine 20 receives via the user interface 56 a set of user instructions defining or selecting a wash cycle to be executed, and the indicated cycle is executed in stage 310. After the cycle has finished, the process flows to stage 311, wherein the drop-off mode is reactivated and the process returns to stage 306.

The drop-off process 300 described above is useful when an operator of a laundry facility desires to use the laundry machines to process clothes received or "dropped-off" by customers to be washed for the customer. In addition, the drop-off function may be used to allow a machine 20 to be used by a customer as part of a promotion or to fulfill refund obligations, or to otherwise provide service without requiring payment.

Figure 4:
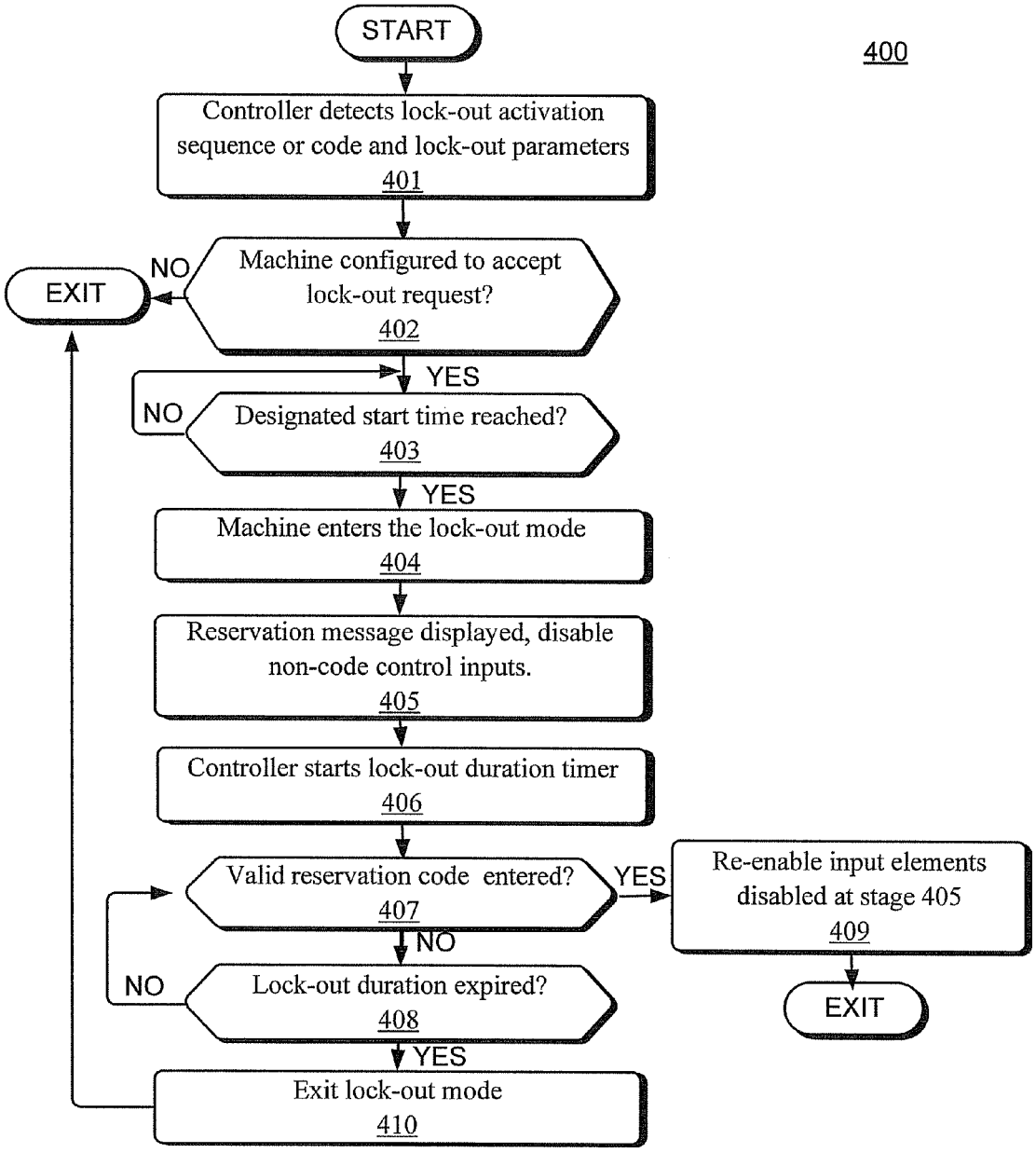
FIG. 4 is a flowchart showing a process of initiating and functioning within a lock-out mode according to an embodiment of the invention.

A similar machine mode that is useful in the same or different circumstances is referred to herein as a lock-out mode. This mode makes the machine 20 available for use only to members of the public that are able to enter a predetermined unlock code. This is useful, for example, in enabling users to reserve machines locally or remotely so that they may know that a machine will be available for them to use at a reserved time. The process 400 illustrated in the flow chart of FIG. 4 illustrates an exemplary process for locking and unlocking a machine 20, but it will be appreciated that other similar processes may be used without departing from the scope of the invention.

At stage 401, the machine 20 (i.e., via the processor therein) detects a lock-out activation sequence or code as well as a sequence of lock-out parameters. In a preferred embodiment of the invention, the lockout code is received from a remote source, e.g., a remote user in communication with the machine via one or more servers to reserve the machine for a certain time. The sequence of lock-out parameters preferably identifies the time period during which the machine should be reserved. Typically, for example, the sequence of lock-out parameters will include a start time (e.g., hour and minute) and duration (e.g., a specified number of hours and/or minutes).

In accordance with a feature of the invention, once the lock-out activation code and lock-out parameters are received, the machine controller 50 determines at stage 402 whether the machine 20 is configured to accept a lock-out request, e.g., via a configuration file, setting or otherwise. If it is determined at stage 402 that the machine 20 is not configured so as to accept a lock-out request, then the process 400 exits after stage 402. Otherwise, the process 400 moves forward to stage 403, wherein the machine 20 determines whether the designated start time has been reached. If it is determined at stage 403 that the designated start time has not been reached, then the process 400 loops through stage 403 until such time as the designated start time has been reached.

When the designated start time has been reached, the process 400 proceeds to stage 404, wherein the machine 20 enters the lock-out mode. Pursuant to entering the lock-out mode, the controller 50 causes an appropriate message to be displayed via the user display 56 panel in stage 405. For example, the display may be changed to read "res," "reserved," or other appropriate message to alert potential users that the machine 20 has been reserved by another user. In addition, the controller 50 disables or ignores any coin deposit, card insertion, start button depression and/or other control inputs other than those needed to enter a reservation code. In addition, when the machine 20 enters the lock-out mode it also starts a timer in stage 406. The machine 20 will exit the lock-out mode either when the appropriate reservation code is entered during the duration of the lock-out period or when the lockout period expires.

Thus, at stage 407, the machine 20 determines whether a valid reservation code has been entered, e.g., by comparing any entered reservation code with a known valid reservation code. If it is determined at stage 407 that a valid reservation code has been entered, the process 400 flows to stage 409. Otherwise the process flows to stage 408, wherein the machine 20 determines whether the lock-out duration has expired, e.g., whether the timer matches the specified duration. If it is determined at stage 408 that the lock-out duration has expired, the process flows to stage 410, wherein the machine 20 exits the lock-out mode, and the process exits. Otherwise, if it is determined at stage 408 that the lock-out duration has not expired, the process returns to stage 407.

Referring still to FIG. 4, if it was determined at stage 407 that a valid reservation code had been entered and the process 400 continued to stage 409, the machine 20 unlocks the user interface 56 elements that were locked at stage 405 and exits. At this point, the user is able to pay or otherwise activate the machine 20 for use and enter the appropriate instructions to cause the machine 20 to execute a desired wash cycle.

Figure 5:
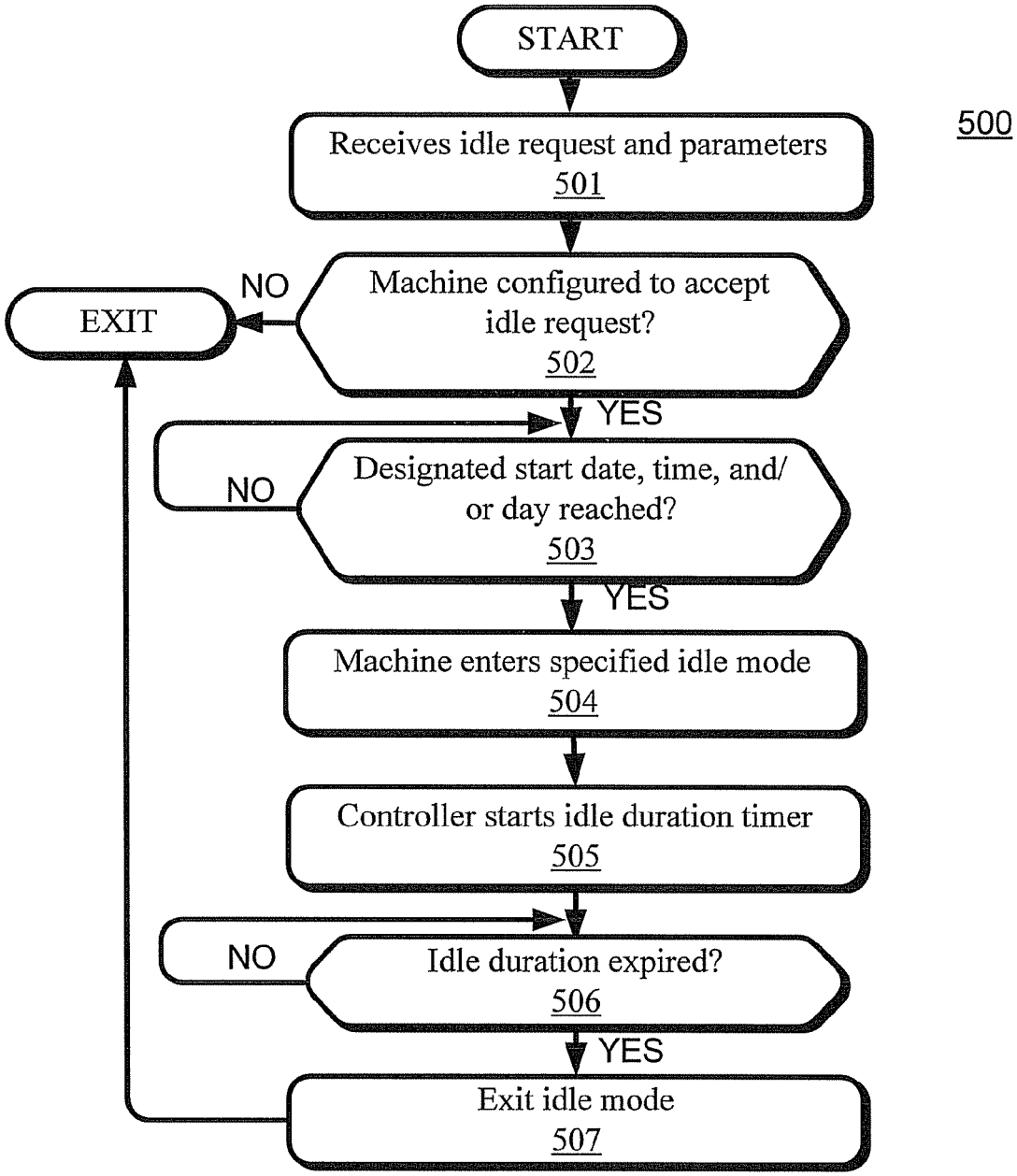
FIG. 5 is a flowchart showing a process of initiating and functioning within an idle mode according to an embodiment of the invention.

In order to save electrical power during idle periods or periods of traditionally low usage, the machine 20 may also be configured to accept a request to enter a low power or shut down mode (also referred to generally herein as idle modes). These modes enable a facility to conserve electrical power, but they render the machine 20 less readily usable in that the machine 20 must be caused to exit the low power/shut down mode prior to use. The flow chart of FIG. 5 illustrates a process 500 for machine entry to, and behavior during, such a mode.

At stage 501, the machine 20 receives at its controller 50 via a network connection, or by comparing a current date, day and/or time with a preprogrammed date, day, and/or time, or other operator interface 56 a request to enter shut down/low power mode, as well as a set of shut down/low power parameters. The shut down/low power parameters preferably include a start and end time, or a start time and duration. In accordance with a feature of the invention, once the shut down/low power mode request and parameters are received, the machine controller 50 determines at stage 502 whether the machine 20 is configured to accept a shut down/low power request, e.g., via a configuration file, setting or otherwise. Typically, the configuration information will specify which of the idle modes is enabled, as different modes will exhibit different behaviors.

If the machine 20 is not configured to accept an idle request, then the process 500 exits. Otherwise, the process 500 moves forward to stage 503, wherein the machine 20 determines whether the designated start date and time has been reached. If it is determined at stage 503 that the designated start date and time has not been reached, then the process 500 loops through stage 503 until the designated start date and time is reached.

At the designated start date and time, the process proceeds to stage 504, wherein the machine 20 enters the configured idle mode. As noted above, the machine 20 supports two idle modes, namely a shut-down mode and a low-power mode. In the shut-down mode, the machine 20 is using less electrical energy than it would when active, but there is still power supplied to and derived from a transformer associated with the power circuit of the machine 20. Is this mode, the machine 20 will not be usable by customers, but the display will be active, and may display a message such as "off."

In the low power mode, the screen may be blank. However, in both modes, the communications facilities of the machine 20 remain active to allow remote awakening of the machine if desired.

When the machine 20 enters the idle mode, the controller 50 sets an idle timer at stage 505 so that the end of the desired idle period can be ascertained. At stage 506, the controller continually checks the idle timer to determine whether the idle period has expired. When it is determined that the idle period has expired, the controller 50 exits the idle mode and the process 500 exits.

Timing is also significant for purposes of warranty expiration and service expectations. In particular, it is useful to know generally when a machine was installed, but starting a warranty expiration count down at the moment a machine is installed would disadvantage customers. In particular, during the first several runs of the machine, it is typical to perform adjustments and service and to otherwise use the machine for set up rather than commercial or other profitable purposes.

Thus, in a further embodiment of the invention, the installation date is fixed after a predetermined number of cycles of the machine. In the described embodiment of the invention, the predetermined number is ten, but any other number, larger or smaller, may be used instead.

Figure 6:
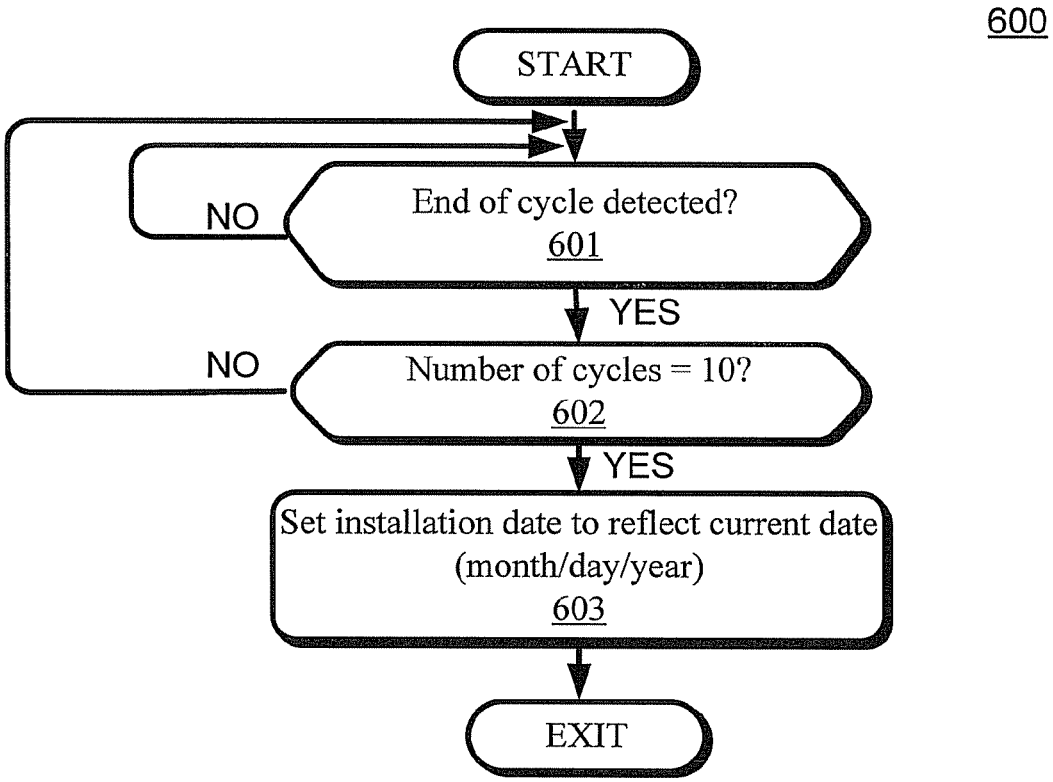
FIG. 6 is a flowchart illustrating a process for setting an installation date in a delayed manner according to an embodiment of the invention to account for time when machine may not be fully operational.

In the exampled of FIG. 6, a process for recording the machine installation date is illustrated. At stage 601 of process 600, the controller awaits the end of a laundry cycle. Once the end of a cycle is detected, the process 600 flows to stage 602. At stage 602, the controller determines whether the number of cycles completed is ten. If it is determined at stage 602 that the number of cycles completed is not yet ten, the process returns to stage 601. Otherwise, the process flows to stage 603, wherein the current date (e.g., month/date/year) is read and recorded as the installation date. The process then exits.

In view of the many possible embodiments to which the principles of this invention may be applied, it should be recognized that the embodiment described herein with respect to the drawing Figures is meant to be illustrative only and should not be taken as limiting the scope of invention. Those of skill in the art will recognize that the elements of the illustrated embodiments can be modified in arrangement and detail without departing from the spirit of the invention. Therefore, the invention as described herein contemplates all such embodiments as may come within the scope of the following claims and equivalents thereof.

We claim:

1. A method of initiating and operating a laundry machine in a drop-off mode comprising:

detecting receipt of a valid activation sequence;

determining whether the laundry machine is able to accept the activation sequence;

causing the laundry machine to perform an action based on the determination of whether the laundry machine is able to accept the activation sequence, the action being selected from the group of actions consisting of (1) remaining in a current mode, wherein the machine is usable, without entering a drop-off mode when the laundry machine is not able to accept the activation sequence, and (2) switching the laundry machine operation to a drop-off mode wherein the machine enters a wait state and is not usable by a user other than by entry of a predetermined user code when the laundry machine is able to accept the activation sequence.

2. The method of initiating and operating a laundry machine according to claim 1, wherein the activation sequence is received via user-manipulation of a user interface associated with the laundry machine.

3. The method of initiating and operating a laundry machine according to claim 1, wherein the activation sequence is received from a remote source via a communication link.

4. The method of initiating and operating a laundry machine according to claim 1, wherein determining whether the laundry machine is able to accept the activation sequence further comprises evaluating at least one of a configuration file and a configuration setting to enable or disable activation of the drop-off mode.

5. The method of initiating and operating a laundry machine according to claim 1, wherein switching the laundry machine operation to a drop-off mode further comprises causing a user-readable message to be displayed via a user display panel.

6. The method of initiating and operating a laundry machine according to claim 1, wherein switching the laundry machine operation to a drop-off mode further comprises disabling one or more control inputs of the laundry machine.

7. The method of initiating and operating a laundry machine according to claim 6, wherein the one or more control inputs of the laundry machine comprise at least one of a coin deposit function, card insertion function, and start button function.

8. The method of initiating and operating a laundry machine according to claim 6, wherein switching the laundry machine operation to a drop-off mode further comprises allowing a user input keypad associated with the laundry machine to remain enabled so as to be able to receive user input via the keypad.

9. The method of initiating and operating a laundry machine according to claim 6, further comprising re-enabling the one or more control inputs of the laundry machine when a valid user code is received.

10. The method of initiating and operating a laundry machine according to claim 1, wherein causing the laundry machine to remain in a current mode without entering a drop-off mode further comprises determining that the machine is currently executing a wash cycle when the activation code is received and continuing to the completion of the cycle.

11. The method of initiating and operating a laundry machine according to claim 10, further comprising receiving an override code and, in response to receipt of the override code, halting the operation of the machine after the activation sequence is received without continuing to the completion of the cycle.

12. The method of initiating and operating a laundry machine according to claim 11, wherein the override sequence comprises a sequence of input button key strokes.

13. The method of initiating and operating a laundry machine according to claim 1, further comprising:

determining that a valid user code has been received; and responsive to determining that a valid user code has been received, switching the laundry machine operation out of the drop-off mode such that it is usable by a user.

14. The method of initiating and operating a laundry machine according to claim 13, wherein switching the laundry machine operation out of the drop-off mode such that it is usable by a user further comprises configuring the machine to operate free of charge.

15. The method of initiating and operating a laundry machine according to claim 13, wherein the valid user code comprises reentry of the drop-off mode activation sequence.

* * * * *